United States Patent [19]

Agata

[11] Patent Number: 4,556,018

[45] Date of Patent: Dec. 3, 1985

[54] STEAM BOILER

[75] Inventor: Akihiko Agata, Isahaya, Japan

[73] Assignee: Shin-Ei Kabushiki Kaisha, Isahaya, Japan

[21] Appl. No.: 675,860

[22] Filed: Nov. 28, 1984

[30] Foreign Application Priority Data

Nov. 28, 1983 [JP] Japan ..... 58-183438[U]

[51] Int. Cl.[4] ..... F22B 37/22

[52] U.S. Cl. ..... 122/35; 60/659; 122/504

[58] Field of Search ..... 122/504, 448 R, 448 S, 122/35, 459; 60/659

[56] References Cited

U.S. PATENT DOCUMENTS

| | | | |
|---|---|---|---|
| 3,042,007 | 7/1962 | Chien et al. | 122/448 R |
| 3,234,920 | 2/1966 | Kemmetmuller et al. | 122/35 X |
| 3,370,572 | 2/1968 | Kurrle | 122/35 X |
| 3,908,897 | 9/1975 | Van Holtz et al. | 122/448 X |
| 4,164,848 | 8/1979 | Gilli et al. | 122/35 X |
| 4,433,646 | 2/1984 | Zadiraka | 122/504 X |
| 4,465,088 | 8/1984 | Vosper | 122/504 X |

*Primary Examiner*—Edward G. Favors

*Attorney, Agent, or Firm*—Obon, Fisher, Spivak, McClelland & Maier

[57] ABSTRACT

A steam boiler having a steam accumulator connected between the boiler and a user, a flow meter provided on the inlet side of the steam accumulator, and a pressure detector provided on the steam accumulator for detecting the internal pressure thereof, wherein the steam boiler is arranged to detect by the flow meter the steam flow rate on the inlet side of the steam accumulator, which is varied in the fashion of following the mean value of steam load, to detect the internal pressure of the steam accumulator by the pressure detector, and to calculate the steam load on the outlet side of the steam accumulator by a steam load detector on the basis of signals of detected steam flow rate and pressure variation.

4 Claims, 2 Drawing Figures

STEAM BOILER

BACKGROUND OF THE INVENTION

1. Field of the Invention

This invention relates to improvements in and relating to steam boiler.

2. Description of the Prior Art

It is known in the art to provide a steam accumulator between a steam boiler and a user in steam using plants or the like for absorbing variations in steam load and thereby preventing the steam load variations from being transmitted directly to the boiler to ensure its stable operation.

The provision of a steam accumulator, however, makes it difficult to detect and record the actual steam load, except the mean value of the steam load which can be detected from the steam flow rate on the outlet or secondary side of the steam accumulator. Therefore, in a case where there is a need for detecting the actual load, it has been the conventional practice to provide a flowmeter on the secondary side. However, since the measurable range of a flowmeter is very narrow, a difficulty is often encountered in correctly measuring the steam flow rate with wide variaty from its maximum to minimum values, coupled with complication of the boiler construction as a whole due to additional piping and wiring.

Although it is possible to employ a flow meter which is constructed in a special form to cover a wide range of measurement, such a flow meter is very costly and often found to be undesirable from an economical point of view.

Further, greater load varuations cause larger variations in the internal pressure of the steam accumulator due to unbalanced flow rates of input and output steam to and from the accumulator, the thus greater variations of the internal pressure make it difficult to control the flow rate of input steam accordingly.

SUMMARY OF THE INVENTION

In view of the foregoing situations, the present invention has as its primary object the provision of a steam boiler in which the actual steam load can be detected without providing a flow meter on the outlet side of a steam accumulator.

It is another object of the present invention to provide a steam boiler which is capable of appropriately controlling the flow rate of input steam to a steam accumulator, namely, the evaporation rate from the boiler, through detection of the level and gradient of the internal pressure of the accumulator.

According to the invention, the foregoing objectives are achieved by the provision of a steam boiler of the type which has a steam accumulator connected between the steam boiler and a user, a flow meter provided on the inlet side of the steam accumulator, and a pressure detector provided on the steam accumulator for detecting the internal pressure thereof, characterized in that the steam boiler comprises a steam load detector adapted to calculate the steam load on the outlet side of the steam accumulator on the basis of a signal of steam flow rate from the flow meter and a signal of pressure variation from the pressure detector.

By the provision of the steam load detector, the flow rate on the secondary side can be accurately measured even if the flow rate is extremely small. In addition, the actual load can be detected simply by an arithmetic operation based on a signal from a flow meter which is provided for the purpose of controlling the flow rate of input steam to the accumulator and a pressure signal from a pressure detector.

The above and other objects, features and advantages of the invention will become apparent from the following description and appended claims, taken in conjunction with the accompanying drawing which shows by way of example a preferred embodiment of the invention and, needless to say, which should not be construed as limitative of the present invention.

DESCRIPTION OF PREFERRED EMBODIMENT

Figure 1:
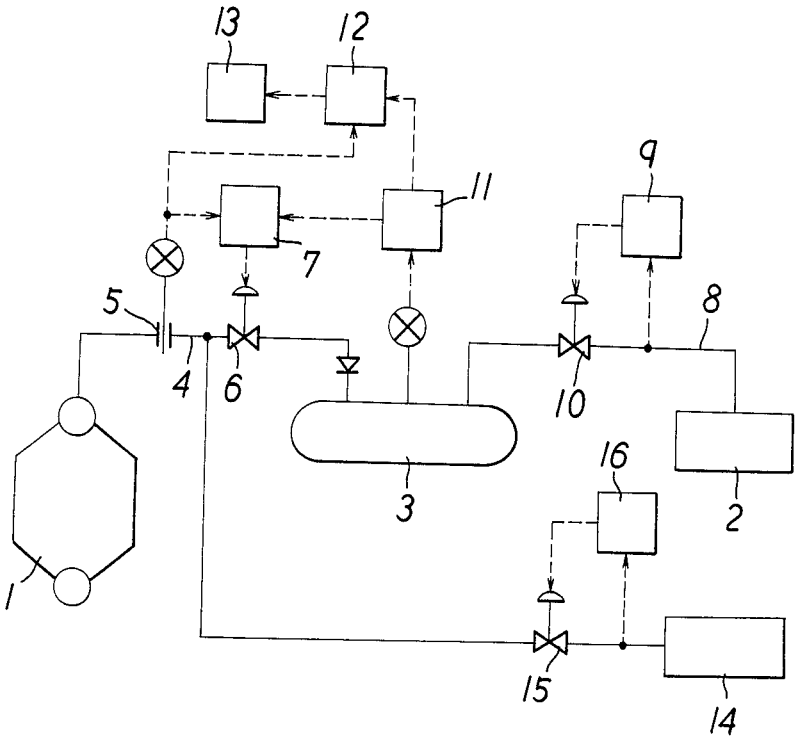
FIG. 1 is a block dragram of a steam boiler embodying the present invention.

Hereafter, the invention is described more particularly with reference to the drawing. In FIG. 1, indicated at 1 is a boiler, at 2 is a low pressure user which uses the steam from the boiler 1, and at 3 is a steam accumulator which is connected between the boiler 1 and low pressure user 2. A primary steam pipe 4 on the inlet side of the steam accumulator 3 is provided with a flowmeter 5 and a flow control valve 6 which is opened and closed by a flow controller 7, while a secondary steam pipe 8 on the outlet side of the steam accumulator 3 is provided with a pressure valve 10 which is opened and closed by a pressure controller 9. Further, the steam accumulator 3 is provided with a pressure detector 11 for detecting its internal pressure. The pressure detector 11 is connected to the flow controller 7.

The pressure detector 11 functions to detect the internal pressure of the steam accumulator 3 and at the same time to calculate the gradient of its variation curve by differentiation, sending a valve choke signal to the flow controller 7 for choking the flow control valve 6 when the detected internal pressure is higher than a predetermined high level and its gradient is positive, while sending a valve open signal when the internal pressure is lower than a predetermined low level and the gradient is negative. The valve choke and open signals are cut off at maximal and minimal points which are located outside the range defined by the high and low levels and at which the gradient of the internal pressure is reversed, thereby controlling the flow control valve 6 to hold the current flow rate at the maximal and minimal points through the valve controller 7. Alternatively, arrangements may be made to produce peak and dip detection signals thereby to control the flow control valve 6 to hold the current flow rate.

Further, connected to the flow meter 5 and pressure detector 11 is a steam load detector 12 which is supplied with the flow signal from the flow meter 5 and at the same time supplied from the pressure detector 11 a signal of the internal pressure of the steam accumulator 3 as a pressure variation signal, calculating the steam load on the basis of these input signals and sending the results to the recorder 13 for recording purposes. In FIG. 1, denoted at 14 is a high pressure user, at 15 is a pressure valve, and at 16 is a valve controller.

In a steam boiler which is arranged in this manner, the steam which is generated in the boiler 1 flows into the steam accumulator 3 through the primary steam pipe 4 and accumulated there as saturated hot water. From the steam accumulator 3, steam is supplied to the low pressure user 2. As steam is used by the low pressure user 2, the pressure on the secondary side is varied correspondingly to the amounts of used steam, and the pressure control valve 10 is automatically opened and closed according to the pressure variations to supply steam to the low pressure user 2 at a flow rate corresponding to the load.

In this instance, if the flow rates of input and output steam are unbalanced due to load variations, causing fluctuations to the internal pressure of the steam accumulator 3, the flow controller 7 is operated by the pressure detector 11 according to the level and gradient of the internal pressure to open or choke the flow control valve 6, thereby controlling the flow rate of steam from the boiler 1 in such a manner as to follow the mean values of the load.

Figure 2:
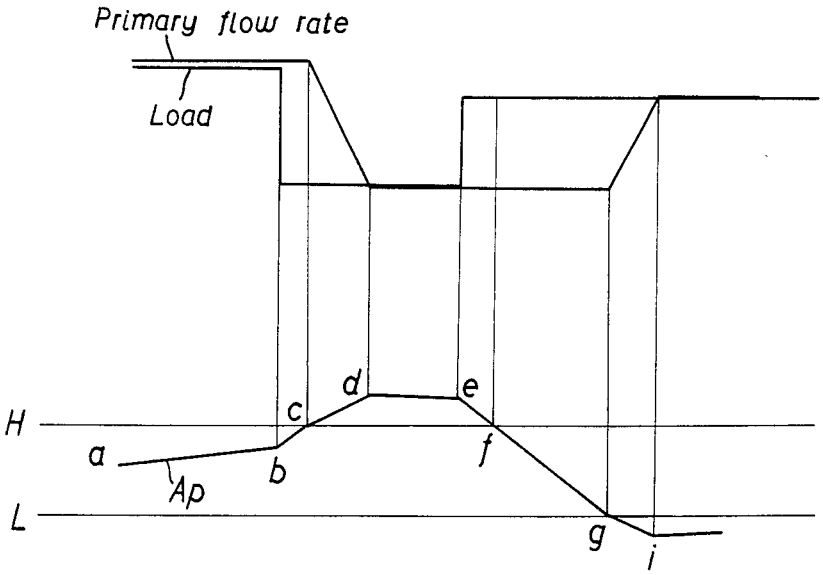
FIG. 2 is a diagram explanatory of a flow rate control method.

Namely, as shown in FIG. 2, when the internal pressure Ap of the steam accumulator 3 is increased beyond a point C at high level H by a load reduction, the flow control valve 6 is gradually choked by the choke signal as long as the gradient remains positive, so that the flow rate is gradually minimized. If the flow rate becomes slightly smaller than the load and the gradient of the internal pressure Ap turns to negative as at point d, the choke signal is cut off so that the flow controller 7 holds the flow control valve 6 at the current flow rate. Accordingly, the flow rate is maintained at a value almost corresponding to the load.

If the internal pressure Ap is gradually lowered by increases of load, beyond a point g at low level L, the flow rate is slowly increased since the flow control valve 6 is opened little by little while the gradient of the internal pressure is negative. As soon as the flow rate slightly exceeds the load and the gradient of the internal pressure Ap turns negative, the valve open signal is cut off to hold the current flow rate. In this manner, the flow rate is automatically controlled at rough mean values relative to the load variations.

As clear from the foregoing description, the supply of steam to the low pressure user 2 is effected by self-evaporation of saturated hot water in the steam accumulator 3 so that the load variations on the side of the low pressure user are not directly transmitted to the boiler 1. Therefore, it is impossible to detect the actual load variations by the flow meter 5 which is provided on the primary side. Nevertheless, the steam flow rate on the secondary side is sequentially detected by a steam load detector 12 which is connected to the flow meter 5 and pressure detector 11, on the basis of the signals from the latter, and the results are recorded by the recorder 13.

The actual flow rate of steam which flows through the secondary steam pipe 8 can be calculated from variations of the internal pressure of the steam accumulator 3 and the flow rate of steam from the boiler 1. Namely, variation $\Delta F$ in the amount of steam in the steam axxumulator 3 can be obtained from pressure variation $\pm dp/dt$ ($+dp/dt$=a pressure increment, $-dp/dt$=a pressure decrement) in the steam accumulator 3, and the steam flow rate $F_0$ through the secondary steam pipe 8 can be calculated from the variation $\Delta F$ in the steam amount and flow rate $F_1$ of steam supplied to the steam accumulator 3, according to the following equation.

$$F_0 = F_1 - \Delta F.$$

The flow rate $F_1$ of steam which is supplied to the steam accumulator 3 is detected by the flow meter 5, while the pressure variation dp/dt in the steam accumulator 3 is detected by the pressure detector 11. Accordingly, the steam load detector 12 which is supplied with signals of the flow rate $F_1$ and the pressure variation dp/dt can calculate the flow rate of steam actually supplied to the uer 2, namely, the actual load accurately even when the flow rate is very small, without requiring provision of a flow meter in the secondary steam pipe 8.

What is claimed is:

1. A steam boiler having a steam accumulator connected between said boiler and a user, a flow meter provided on the inlet side of said steam accumulator, and a pressure detector provided on said steam accumulator for detecting the internal pressure thereof, characterized in that said steam boiler comprises:

a steam load detector adapted to calculate the steam load on the outlet side of said steam accumulator on the basis of a signal of steam flow rate from said flow meter and a signal of pressure variation from said pressure detector.

2. The steam boiler of claim 1, further comprising a flow controller for controlling a steam flow control valve provided between said steam boiler and accumulator, and wherein said pressure detector is arranged to supply a valve choke signal to said flow controller when the internal pressure of said steam accumulator is higher than a predetermined high level and the gradient of said internal pressure is positive, and to supply a valve open signal to said flow controller when said internal pressure is lower than a predetermined low level and said gradient is negative.

3. The steam boiler of claim 1, further comprising a recorder for recording the results of calculation by said steam load detector.

4. The steam boiler of claim 1, further comprising a high pressure user connected to a primary steam pipe on the inlet side of said steam accumulator at a position downsteam of said flow meter.

* * * * *